United States Patent [19]

Jones

[11] Patent Number: 4,468,546

[45] Date of Patent: Aug. 28, 1984

[54] BILGE PUMP ACTIVATOR SWITCH

[75] Inventor: Clarence L. Jones, Houma, La.

[73] Assignee: Pitre-Jones, Inc., Houma, La.

[21] Appl. No.: 497,310

[22] Filed: May 23, 1983

[51] Int. Cl.[3] ..... H01H 35/18

[52] U.S. Cl. ..... 200/84 B

[58] Field of Search ..... 200/84 R, 84 A, 84 B, 200/33 A; 340/623-625

[56] References Cited

U.S. PATENT DOCUMENTS

| | | | |
|---|---|---|---|
| 2,929,889 | 3/1960 | Efther | 200/33 A |
| 3,185,789 | 5/1965 | Gunther | 200/84 R |
| 3,192,337 | 6/1965 | Doty et al. | 200/84 B |
| 3,309,687 | 3/1967 | Phipps | 200/84 B X |
| 4,065,226 | 12/1977 | Campbell | 200/84 R X |

*Primary Examiner*—J. R. Scott

*Attorney, Agent, or Firm*—Bode & Smith

[57] ABSTRACT

A bilge pump switch apparatus for activating and deactivating the bilge pump of the vessel in response to predetermined water levels in the bilge area comprising a housing defining a chamber therein and provided with a fluid port for receiving and discharging bilge water, a mercury tilt switch suspended within the chamber and being responsive to tilting for opening and closing a circuit including a battery, the mercury tilt switch and the bilge pump, and a float responsive to the water level in the chamber for positioning the mercury tilt switch in its normally open position and its normally closed position.

17 Claims, 8 Drawing Figures

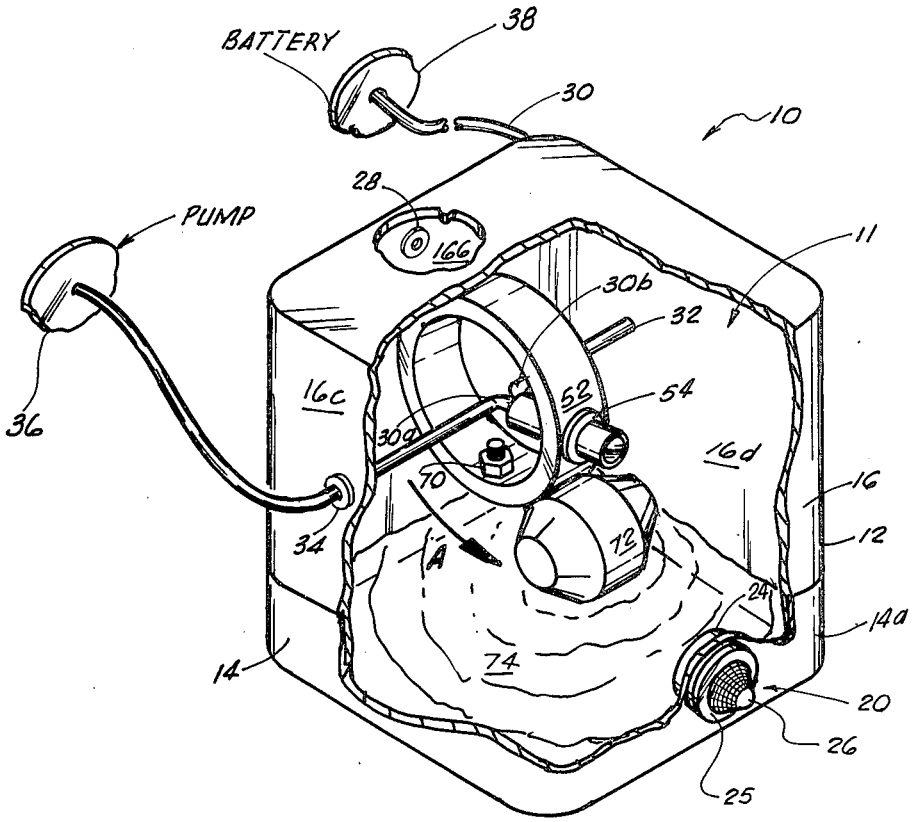
FIG. 7
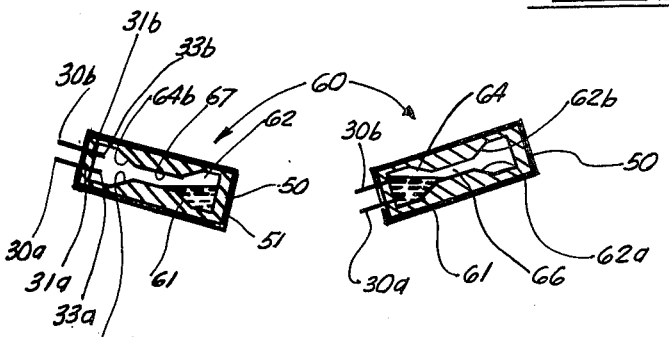
FIG. 5A
FIG. 5B
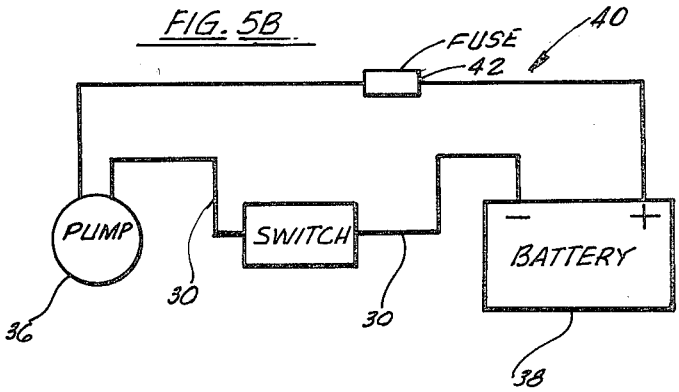
FIG. 6

BILGE PUMP ACTIVATOR SWITCH

BACKGROUND OF THE INVENTION

1. Field of the Invention

The present invention relates to a bilge pump activator switch for use aboard vessels. More particularly, the present invention relates to a bilge pump activator switch which senses the true water level in the bilge area asa function of the water level in its housing, and upon a predetermined water level being reached activates, by means of a mercury switch element, an electrical circuit including a bilge pump, the mercury switch and a battery.

2. General Background

In the marine industry it is essential that bilge pumps be activated and deactivated as a function of a predetermined bilge water level. It is desirable that this predetermined water level be indicated accurately, independent of list of the vessel, and automatically without an individual being required to monitor the bilge water level.

Several attempts have been made in the known art to develop an automatic bilge pump activator switch.

A typical known art device would have a float which would rise with the water level and tilt a mercury switch, thereby completing a circuit including a bilge pump, the mercury switch and a battery. This method is less than acceptable as listing of the vessel can offset the tilt of the mercury switch and maintain the bilge pump-mercury switch-battery circuit open, and thus the bilge pump "off", even though the water level has reached a dangerous level requiring pumping. At the other extreme, listing alone can induce the tilt of the mercury switch and prematurely close the bilge pump-mercury switch-battery circuit, and thus activate the bilge pump, even though the water level remains at an acceptable level; or the listing can induce tilt and maintain an already closed circuit closed and thus the pump "on" even though the bilge water is at an acceptable level and the pump should deactivate thereby causing damage to the bilge pump. It can also be understood therefore, that the listing of the vessel can cause both the premature and delayed opening and closing of the mercury switch and hence unwanted and erratic activation and deactivation of the bilge pump, thus reducing pumping time and expending rapidly the life of the battery—the "on-off-on-off . . . " problem.

Further known art devices use float mechanisms and mercury tilt switches which pivot about lines connected by pins, brackets or other mounting devices which offer resistance and can become fouled with grease or oil which results in restriction and eventually sticking of the float.

GENERAL DISCUSSION OF THE PRESENT INVENTION

The present invention solves the problems and shortcomings of the known art in a simple, inexpensive and straightforward manner. The present invention provides for a bilge pump activator switch responsive to a predetermined water level in the bilge comprising a housing with a bilge water intake/outtake port, and, a float and mercury switch mounted in a ring with a counterweight and suspended solely on the electrical leads of the switch which pass through the housing. Upon the water level in the housing (which is a function of the bilge water level) rising to a predetermined level, the float rises causing the ring to rotate thus tilting the mercury switch to a predetermined angle causing a provided circuit including the bilge pump, mercury switch and a battery to close. An hour-glass configuration of the mercury tilt switch requires the float be lowered (by corresponding lowering of the water level in the housing) to a pre-determined level to again open the circuit.

Thus there is provided a circuit including a bilge pump, a mercury tilt switch and a battery.

There is further provided a float, responsive to water level in the bilge and not responsive to listing of the ship, which can activate and deactivate the bilge pump to pump excess water from the bilge.

There is further provided a bilge pump activator switch with a mercury tilt switch, the orientation of which is controlled by means responsive to water level in the bilge independent of the list of the vessel.

Thus it is an object of the present invention to provide a simple and inexpensive apparatus for activating and deactivating a bilge pump when the water in the bilge reaches a predetermined high or low level.

It is a further object of the present invention to provide a bilge pump activator switch having a float, mercury tilt switch with a suspension system independent of the list of the vessel.

It is a further object of the present invention to provide a bilge pump activator switch having a float, mercury tilt switch and counterweight responsive to bilge water level and suspended solely on the electrical leads of the mercury tilt switch.

It is a further object of the present invention to provide a bilge pump activator switch having a float and mercury tilt switch suspended solely on the electrical leads of the mercury tilt switch, thus allowing pivoting independent of any mounting device.

It is a further object of the present invention to provide a bilge pump activator switch having a self-leveling mercury tilt switch whereby the suspension system permits the mercury switch to respond to bilge water level independent of the list of the vessel.

It is a further object of the present invention to provide a mercury tilt switch with an hour-glass configuration which thereby retains the mercury element until the float elevates to approximately twenty degrees above the horizontal position of level or descends to approximately twenty degrees below the horizontal position of level.

BRIEF DESCRIPTION OF THE DRAWINGS

For a further understanding of the nature and objects of the present invention, reference should be had to the following description, taken in conjunction with the accompanying drawings in which like parts are given like reference numerals and, wherein:

FIG. 5A is a sectional view of the mercury switch of the present invention in the "opened" position of FIG. 3; and FIG. 5B is a sectional view of the mercury switch of the apparatus of the present invention in the "closed" position of FIG. 4;

FIG. 6 is a schematic illustration of the circuitry of the apparatus of the present invention; and FIG. 7 is a perspective cut-away view of the apparatus of the present invention.

DETAILED DESCRIPTION OF THE PREFERRED EMBODIMENT

Figure 1:
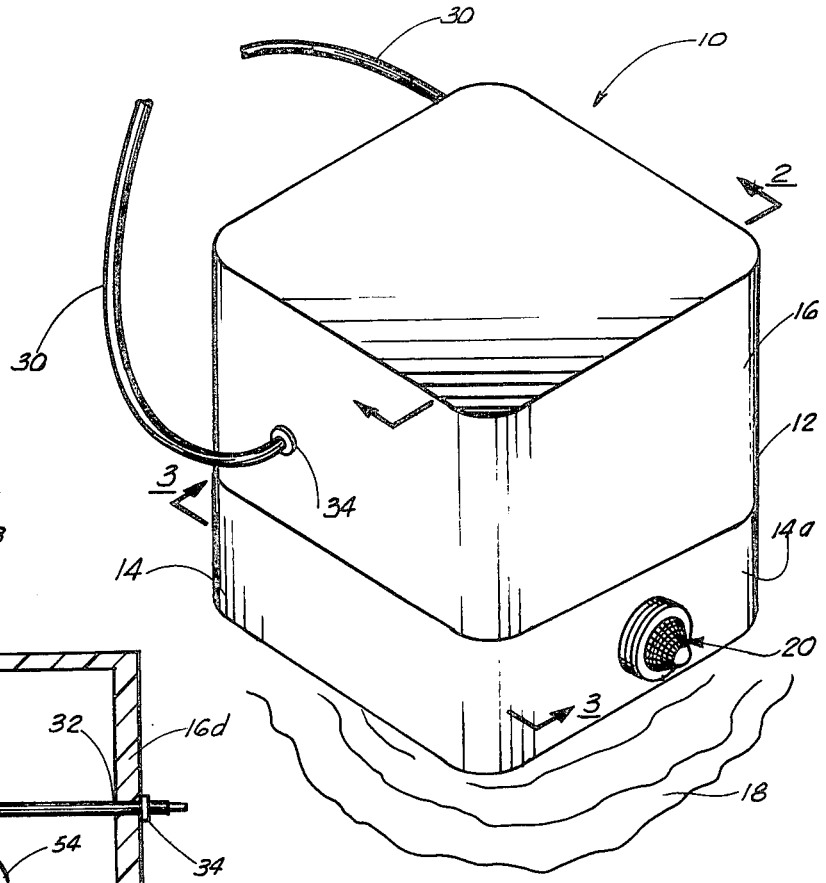
FIG. 1 is a perspective view of the apparatus of the present invention.

FIGS. 1 and 7 best illustrate the preferred embodiment of the apparatus of the present invention designated generally by the numeral 10. In FIGS. 1 and 7 it can be seen that apparatus 10 is comprised of a housing 12 having lower and upper housing portions 14 and 16 respectively, housing 10 thus defining chamber 11. Lower housing portion 14 is mounted to deck 18 of the bilge area of a vessel. In this way upper housing portion 16 is removable to allow for repair, maintenance or replacement of parts within housing 12.

Figure 3:
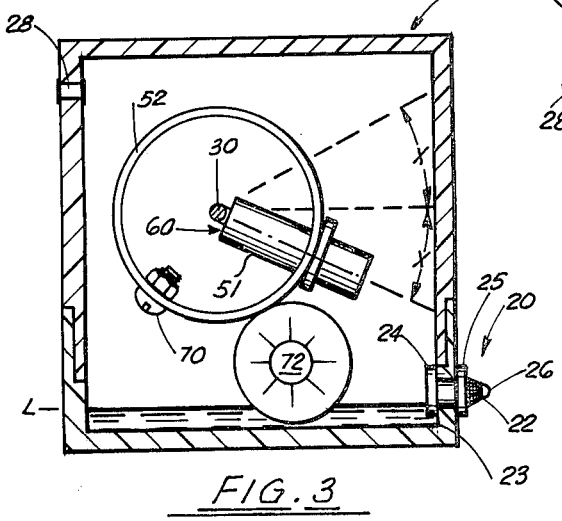
FIG. 3 is a sectional view of the apparatus of the present invention taken along line 3—3 of FIG. 1 and showing the mercury switch in the "open" position.

As best seen in FIGS. 1, 3 and 7, lower housing portion 14 is provided with fluid intake/outtake port 20 at a lower portion of one of its sidewalls 14*a* to allow for the introduction of fluid into chamber 11 of housing 12. Fluid intake/outtake port 20 is provided with fluid passageway 22 containing nozzle 23 concentric therewith and having an interior gasket 24 and exterior gasket 25 for retaining said nozzle 23 in fluid passageway 22. A removable and replaceable screen 26 is adapted to be mounted on exterior gasket 25 to filter particulate matter, oil, grease and the like from fluid 74 entering chamber 11 of housing 12 through intake port 20. In conventional adaptation of apparatus 10 in the bilge of a vessel, fluid 74 will be water, either fresh water or brine, containing various particulate matter depending on the geographical location, climate and environmental conditions.

Figure 2:
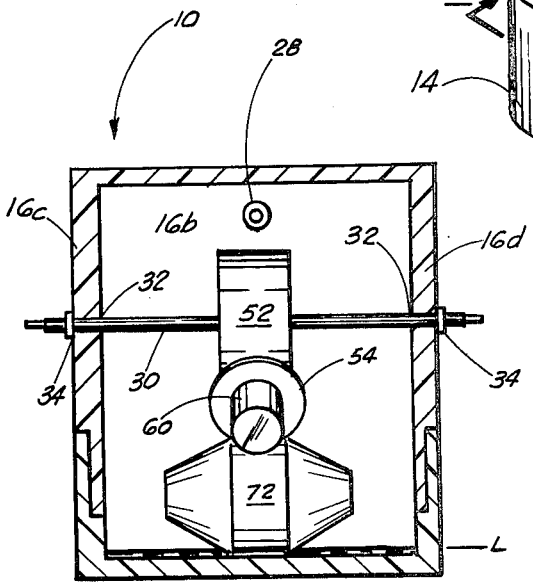
FIG. 2 is a sectional view of the apparatus of the present invention taken along line 2—2 of FIG. 1.

As seen in FIGS. 2 and 7, housing 12 is further provided with air outlet or exhaust port 28 in one of the sidewalls 16*b* of upper housing portion 16 for fluid communication with chamber 11. The diameter of water intake/outtake port 20 and therefore nozzle 23 is substantially larger than the diameter of air outlet port 28 to create an intrusion pressure differential during water intake into chamber 11 and a partial vacuum retard under gravity expulsion of water from chamber 11, the effects of which are discussed further herein.

As best seen in FIGS. 1, 2 and 7, upper portion 16 of housing 12 is further provided with a pair of ports or apertures 32 in opposing walls 16*c*, 16*d* thereof for passing electrical line 30 therethrough. At the outer surface of opposing walls 16*c*, 16*d* of upper housing portion 16 electrical line 30 is provided with gaskets 34 for effectively sealing ports 32 to prevent the leakage of fluid.

As illustrated in FIGS. 6 and 7, electrical line 30 is provided in circuit 40 further including bilge pump 36, bilge pump activator switch 10, a source of electrical power or battery 38 and fuse 42. The operation or activation of circuit 40 by the apparatus of the present invention 10 will be discussed further herein.

Referring now to FIGS. 2, 3, 4, 5 and 7, the apparatus of the present invention 10 further comprises mercury tilt switch 60 suspended in chamber 11 on leads 30*a*, 30*b* of electrical line 30. Mercury tilt switch 60 is provided in a steel casing 50 with a vinyl seal 51 to insure insulation of mercury switch 60 from water contamination. Casing 50 is mounted in ring or wheel 52 such that electrical lead 30 forms the axis of rotation of ring 52 and casing 50 and therefore mercury switch 60 which, as is apparent, extends radially from electrical line 30 and substantially perpendicular thereto. A grommet 54 is provided to secure mercury switch casing 50 in ring 52.

As best seen in FIG. 5, sealed mercury tilt switch 60 provides for a unique hour-glass configuration, the operation of which will be described further herein. Mercury switch 60 comprises housing or steel casing 50 having therein a pair of chambers 62 and 64 communicating by means of orifice portion 66 formed by the interior convergent walls 62*a*, 62*b* of chamber 62, and 64*a*, 64*b* of chamber 64 and neck portion 67. Further provided in one of the chambers 62, 64 of steel casing or housing 50 is quantum of mercury 61. In chamber 64 is provided electrical leads 30*a* and 30*b* of electrical line 30 of circuit 40.

Figure 4:
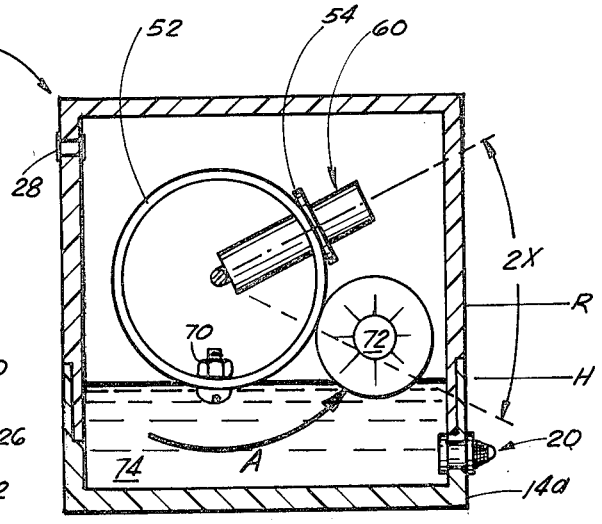
FIG. 4 is a sectional view of the apparatus of the present invention taken along line 3—3 of FIG. 1 and showing the mercury switch in the "closed" position.

As best seen in FIGS. 2, 3, 4 and 7, fixedly mounted to the outer cicumference of ring 52 and disposed radially clockwise of mercury switch 60 is float 72. Further provided in ring 52 in the lower circumferential half thereof but in the opposing quadrant to float 72 is counterweight or ballast 70, thus the static balance of ring 52 and thus float 72 is maintained; and thus mercury tilt switch 60 assumes the static position of FIG. 3. Counterweight or ballast 70 can be of any conventional type and in the preferred embodiment of the apparatus of the present invention as illustrated in FIGS. 3,4 and 7, a conventional nut and bolt is employed.

In operation apparatus 10 is provided in electrical circuit 40 of FIG. 6 further including bilge pump 36, electrical source of power or battery 38 and fuse 42. As the vessel takes on water and the water level in the bilge area rises, water 74 enters chamber 11 through intake 20 and the level of water 74 in chamber 11 rises from the ambient level L toward the predetermined high level H of FIG. 4, thereby causing float 72 to be forced upward thus causing ring 52 and thus mercury switch 60 to rotate in the counter-clockwise direction of Arrow A. When the level of water 74 in chamber 11 reaches the predetermined level H, mercury tilt switch 60 has rotated from the position of FIG. 3 through the angle X to the position of FIG. 4. It should be understood that during water intake into chamber 11, the level of water 74 in chamber 11 will be slightly less than the water level R outside of housing 12 in the bilge area. This differential of level, and resulting pressure differential is a function of the diameter of passageway 22. Upon reaching the position of FIG. 4, quantum of mercury 61 has been able under the force of gravity to climb inclined wall 62*a* of chamber 62 and pass through orifice 66 and into chamber 64 where it now comes into contact with switch contacts 33*a*, 33*b* of leads 30*a*, 30*b* of electrical line 30 thus completing or closing the circuit between bilge pump 36 and battery 38. Thus electrical power is provided to bilge pump 36 and the pumping cycle begins thus expelling water from the bilge area and chamber 11 through intake/outtake port 20 now functioning in the outtake mode. Mercury switch 60 completes an approximately forty (40) degree cycle (2×) through lift from the position of FIG. 3 to that of FIG. 4 before a completion of circuit 40 takes place and the pumping cycle of bilge pump 36 begins.

Similarly, for quantum of mercury 61 under the force of gravity to climb inclined wall 64*a* to be removed from chamber 64 and pass back into chamber 62 and therefore open the circuit between leads 30*a* and 30*b*, mercury switch 60 must rotate approximately forty (40) degrees (2×) clockwise or in the direction opposite Arrow A from the position of FIG. 4 to the position of FIG. 3. Thus with circuit 40 and pump 36 deactivated the pumping cycle is terminated. This lowering of float 72 and hence clockwise rotation of ring 52 and thus lowering of mercury switch 60 to the position of FIG. 3 occurs when pump 36 removes water 74 from the bilge area and thus chamber 11 and thereby lowers the water level in chamber 11 to at/or below ambient level L. Upon the water level in housing 12 reaching ambient level L, quantum of mercury 61 travels from chamber 64 through orifice 66 into chamber 61 thus opening the circuit between lines 30*a* and 30*b* and deactivating pump 36. It should be understood that during discharge of water 74 from chamber 11 through outtake 20, the level of water 74 in chamber 11 will be slightly above that of the water outside of housing 12 in the bilge area; this difference, and resulting pressure differential being a function of the diameter of passageway 22.

It can be seen therefore that if water 74 again enters the bilge area and thus chamber 11 through intake port 20, the water level will again rise to predetermined water level H at which point mercury switch 60 will assume the position of FIG. 4 and circuit 40 will again be closed and bilge pump 36 reactivated to again cause removal of water from the bilge area and chamber 11; then again by the lowering of the water level and therefore float 72 and tilting mercury switch 60 back to the position of FIG. 3, circuit 40 can be opened and pump 36 can be deactivated. The cycle thus repeats itself again and again.

Water intake port 20 provided at the bottom of lower housing portion 14 is of a diameter substantially larger than air exhaust orifice 28 in upper housing portion 16 to create an intrusion pressure differential during intake so that chamber 11 can fill quickly to activate bilge pump 36 at the earliest time possible. With the structure of the apparatus of the present invention, upon water outtake when the pump is discharging the existence of a partial vacuum retard under gravity thereby causes the level of water 74 in chamber 11 to be higher than the water level in the bilge area outside housing 12 thereby causing the discharge of pump 36 to continue even though the level of water 74 in the bilge area is below level L. In this way pumping time is extended so that bilge pump 36 will not fluctuate radically from the "on" to the "off" to the "on" position thus decreasing drastically the efficiency of bilge pump 36. Also, with the control of the level of water 74 in chamber 11 in this way, float 72 and mercury switch 60 are lowered easily. Further, the extended pumping time prevents water back up in the discharge line of bilge pump 36 as such water, upon the deactivation of pump 36, tends to reenter chamber 11, causing the level of water 74 to rise and again activate mercury switch 60 and thus pump 36 to repump the same water.

Electrical line 30 in the preferred embodiment is of a silicon rubber composition and thus highly non-susceptable to stress or fatigue as a result of the rotational flexation imparted when float 72 rises and mercury switch 60 rotates. The tight fit required for gaskets 34 to prevent leakage through ports 32 produces the necessary tension on electrical leads 30*a*, 30*b* thereby preventing slippage and allowing electrical leads 30*a*, 30*b* to support ring 52, switch 60, counterweight 70 and float 72.

Mercury switch 60 is contained in a steel capsule 50 with ceramic insulated contact posts 31*a* and 31*b* intruded in capsule 50 providing leads 30*a* and 30*b* which are hermetically sealed. The steel element capsule casing 50 is then permanently sealed in permeable resistant vinyl material 51.

It can be seen that there is no component of apparatus 10 to rust or corrode and further it cannot be effected by electrolysis.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A bilge pump switch apparatus for activating and deactivating the bilge pump of a vessel comprising:

a. a housing defining a chamber therein and provided with a fluid port communicating with the bilge of said vessel;

b. a mercury tilt switch provided within said chamber being responsive to tilting for opening and closing its circuit;

c. means operatively connected with said mercury switch responsive to the fluid level within said chamber for positioning said mercury tilt switch in a first position whereby its circuit is normally opened and in a second position whereby its circuit is normally closed;

d. a source of electrical power external to said housing;

e. a circuit comprising said source of electrical power, said mercury tilt switch and said bilge pump; and f. means to create a vacuum retard of expulsion of fluid from said housing, said fluid maintaining said mercury tilt switch in said second closed position for an extended period.

2. The apparatus of claim 1 further comprising means for biasing said mercury tilt switch toward its said first position.

3. The apparatus of claim 1 wherein said positioning means is a float member.

4. The apparatus of claim 1 wherein said source of electrical power is a battery.

5. The apparatus of claim 1 wherein said mercury tilt switch comprises a sealed body having first and second chambers for retaining a quantum of mercury therein, said chambers communicating by means of an orifice, and one of said chambers provided with electrical contacts of said circuit whereby approximately forty degrees of rotation is required to move said mercury switch between said first and second positions.

6. A bilge pump switch apparatus for activating and deactivating the bilge pump of a vessel comprising:

a. a housing defining a chamber therein and provided with a fluid port communicating with the bilge of said vessel;

b. a mercury tilt switch provided within said chamber being responsive to tilting for opening and closing its circuit;

c. means operatively connected with said mercury switch responsive to the fluid level within said chamber for positioning said mercury tilt switch in a first position whereby its circuit is normally opened and in a second position whereby its circuit is normally closed;

d. a source of electrical power external to said housing;

e. a circuit comprising said source of electrical power, said mercury tilt switch and said bilge pump;

f. means for biasing said mercury tilt switch toward said first position; and g. means to create a vacuum retard of expulsion of fluid from said housing, said fluid maintaining said mercury tilt switch in said second closed position for an extended period.

7. The apparatus of claim 6 wherein said positioning means is a float member.

8. The apparatus of claim 6 further comprising means, independent of said means for positioning said switch in said first and second positions, for suspending said mercury tilt switch within said chamber whereby said mercury tilt switch is not responsive to the tilting of said vessel.

9. The apparatus of claim 6 wherein said means for biasing said mercury tilt switch toward said first position comprises:

a. means suspended within said chamber by engagement with said mercury tilt switch for securing said mercury tilt switch in a predetermined plane of rotation; and b. a counterweight mounted in said means for securing said mercury tilt switch in a predetermined plane of rotation.

10. The apparatus of claim 9 wherein said means for positioning said mercury tilt switch in said first and second positions is mounted to said means for securing said mercury tilt switch in a predetermined plane of rotation intermediate said mercury tilt switch and said counterweight.

11. The apparatus of claim 6 wherein said mercury tilt switch is suspended in said chamber by its electrical leads provided in said circuit, said mercury tilt switch extending radially and substantially perpendicular to said electrical leads to form an axis of rotation around said electrical leads.

12. A bilge switch apparatus for activating and deactivating the bilge pump of a vessel comprising:

a. a housing defining a chamber therein and provided with a first fluid port communicating with the bilge of said vessel;

b. a mercury tilt switch provided within said chamber being responsive to tilting for opening and closing its circuit;

c. means operatively connected with said mercury tilt switch responsive to the fluid level within said chamber for positioning said mercury tilt switch in a first position whereby its circuit is normally opened and a second position whereby its circuit is normally closed;

d. a source of electrical power external to said housing;

e. a circuit comprising said source of electrical power, said mercury tilt switch and said bilge pump;

f. means for biasing said mercury tilt switch toward said first position further comprising:

(1) means suspended within said chamber by engagement with said mercury switch for securing said mercury tilt switch in a predetermined plane of rotation; and (2) a counterweight mounted in said means suspended within said chamber for securing said mercury tilt switch in a predetermined plane of rotation; and g. said housing having a second fluid port substantially smaller than said first fluid port so that a fluid flow retard is created in said housing during expulsion of fluid from said housing, said fluid maintaining said mercury tilt switch in said second closed position for an extended period.

13. The apparatus of claim 12 wherein said mercury tilt switch is suspended in said chamber by its electrical leads provided in said circuit, said mercury tilt switch extending radially and substantially perpendicular to said electrical leads to form an axis of rotation around said electrical leads.

14. The apparatus of claim 12 wherein said positioning means is a float member.

15. The apparatus of claim 12 wherein a second fluid port is provided in said housing, said second port being of a diameter smaller than the diameter of said first fluid port.

16. The apparatus of claim 12 wherein said mercury tilt switch comprises a sealed closure having first and second chambers for retaining a quantum of mercury therein, said chambers communicating by means of an orifice, and one of said chambers provided with electrical contacts of said circuit.

17. The apparatus of claim 16 wherein said first and second chambers and orifice of said mercury tilt switch adopt an hour-glass configuration whereby approximately forty degrees of rotation is required to move said mercury switch between said first and second positions.

* * * * *